US007240789B2

(12) United States Patent
Sutherland

(10) Patent No.: US 7,240,789 B2
(45) **Date of Patent: *Jul. 10, 2007**

(54) CARTON WITH AN INTERLOCKING SEPARATOR PAD AND DISPENSER

(75) Inventor: Robert L. Sutherland, Kennesaw, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 228 days.

This patent is subject to a terminal disclaimer.

(21) Appl. No.: 10/770,756

(22) Filed: Feb. 3, 2004

(65) Prior Publication Data

US 2005/0167291 A1 Aug. 4, 2005

(51) Int. Cl.
*B65D 75/00* (2006.01)

(52) U.S. Cl. ..... 206/170; 206/427; 229/120.32; 229/120.38

(58) Field of Classification Search ..... 206/170, 206/175, 427, 430, 434; 229/120.32, 122, 229/120.38; 221/305
See application file for complete search history.

(56) References Cited

U.S. PATENT DOCUMENTS

| | | | | |
|---|---|---|---|---|
| 1,896,326 A | | 2/1933 | Northway-Ley | |
| 1,898,646 A | | 2/1933 | Taylor | |
| 2,875,942 A | | 3/1959 | Wilson | |
| 3,822,785 A | | 7/1974 | Getz et al. | |
| 3,937,326 A | * | 2/1976 | Schick | 206/465 |
| 4,120,443 A | | 10/1978 | Gardner et al. | |
| 4,421,229 A | | 12/1983 | Pan et al. | |
| 5,234,102 A | | 8/1993 | Schuster et al. | |
| 5,246,113 A | | 9/1993 | Schuster | |
| 5,415,344 A | | 5/1995 | Harrelson | |
| 5,437,143 A | * | 8/1995 | Culpepper et al. | 53/445 |
| 5,518,111 A | * | 5/1996 | Stout | 206/160 |
| 5,620,094 A | | 4/1997 | Naumann | |
| 5,669,500 A | * | 9/1997 | Sutherland | 206/427 |

(Continued)

FOREIGN PATENT DOCUMENTS

| | | |
|---|---|---|
| CH | 263456 | 8/1949 |

(Continued)

*Primary Examiner*—David T. Fidei
(74) *Attorney, Agent, or Firm*—Womble Carlyle Sandridge & Rice, PLLC

(57) ABSTRACT

A carton for carrying containers, such as cans, or other articles in two layers which has an interlocking separator pad between the two layers is provided. This separator pad has two tabs on each end which extend through slots provided on the side end flaps on each end of the carton to hold the separator pad in proper position between two layers of articles or containers. The pad has a leading flap that is folded up or down on one end of the carton between the articles or containers and the side end flaps to assist in holding the separator pad in proper position during the removal of containers from the carton through a dispenser opening formed in the carton. Preferably, the separator pad has a leading flap on both ends to assist in holding the separator pad in proper position. This carton may be provided with a dispenser in the side panel near the end on which the carton is rested to dispense cans. This dispenser may extend into the top panel and the bottom panel so that the ends of the cans can be grasped for easy removal.

38 Claims, 5 Drawing Sheets

U.S. PATENT DOCUMENTS

| | | | | |
|---|---|---|---|---|
| 5,682,984 | A | 11/1997 | Hoell et al. | |
| 5,772,030 | A | 6/1998 | Baxter | |
| 5,826,870 | A | 10/1998 | Vulgamore et al. | |
| 5,868,252 | A | 2/1999 | Oliff | |
| 5,938,109 | A | 8/1999 | Sainz et al. | |
| 5,957,288 | A | 9/1999 | Campbell | |
| 5,967,406 | A | 10/1999 | Moorman | |
| 5,996,883 | A | 12/1999 | Bates | |
| 6,012,630 | A | 1/2000 | Block | |
| 6,112,977 | A | 9/2000 | Sutherland et al. | |
| 6,176,419 | B1 | 1/2001 | Holley, Jr. | |
| 2005/0115843 | A1 | 6/2005 | Harrelson | |
| 2005/0167290 | A1 | 8/2005 | Sutherland | |
| 2005/0167292 | A1* | 8/2005 | Sutherland | 206/170 |

FOREIGN PATENT DOCUMENTS

| | | | |
|---|---|---|---|
| DE | 88 14 144.6 | | 1/1989 |
| DE | 91 11 941.3 | | 2/1992 |
| FR | 1.427.897 | | 4/1966 |
| FR | 1.489.087 | | 7/1967 |
| FR | 1.497.652 | | 10/1967 |
| FR | 2.223.985 | | 10/1974 |
| GB | 434145 | | 8/1935 |
| GB | 2 198 709 | A | 6/1988 |
| GB | 2 323 352 | | 9/1998 |
| JP | 7-125745 | | 5/1995 |
| JP | 9-142449 | | 6/1997 |
| JP | 11-130049 | | 5/1999 |
| JP | 2000-85754 | | 3/2000 |
| WO | WO 96/29261 | | 9/1996 |
| WO | WO 02/030764 | A3 | 4/2002 |
| WO | WO2004/014755 | A1 | 2/2004 |

* cited by examiner

CARTON WITH AN INTERLOCKING SEPARATOR PAD AND DISPENSER

BACKGROUND OF THE INVENTION

1. Field of the Invention

The present invention relates generally to a carton for carrying cylindrical containers or other types of articles in two layers, with each layer having two or more rows. An interlocking divider pad, or separator pad, is provided which interlocks with the side end flaps on both ends of the carton. This separator pad has two tabs on each end which are inserted through slots in the side end flaps. This carton may have a dispenser in a side panel to permit easy access and removal of the containers in the carton.

2. Background

Fully enclosed cartons that are capable of carrying cans have been used in the past that have a feature for dispensing the cans one at a time. Many of these dispensers do not work in a satisfactory fashion when the cans are carried in two layers. It is desirable to carry cans of certain products in two layers, especially when the can size is small. It would be desirable to have a dispenser that would permit the dispensing of cans from each layer in a carton that contains two layers of cans. It would be desirable to have a divider or separator pad separating the two layers of cans in order for the dispenser on the carton to work properly. Otherwise, the cans in one layer could interfere with the dispensing of cans in the other layer. It would also be desirable to have a divider, or separator, pad that would remain in place during the dispensing of all cans in the carton. It would also be desirable to have a divider, or separator, pad that would work with the dispenser in the side panel of the carton.

SUMMARY OF THE INVENTION

Briefly described, the present invention relates to a fully enclosed carton that is capable of carrying two layers of cans or other articles which has an interlocking separator, or divider, pad separating the two layers of cans or other articles. The carton has a bottom panel, top panel and foldably attached side panels. Preferably each end of the carton is closed by a pair of side end flaps to which a top end flap and bottom end flap are secured, preferably by glue. Both ends of the carton are interlocking ends with each side end flap having at least one slot. The separator pad has at least two tabs on each end which extend through the slots in the side end flaps. The separator pad has a leading flap foldably attached to the pad on at least one end which is folded up or down between the articles or containers (in one layer in the carton) and the adjoining side end flaps. Preferably the separator pad has two leading flaps. Once the leading flaps on the separator pad have been folded up or down, and the side end flaps on each end of the carton are closed, the tabs on the separator pads extend through the slots in the side end flaps. The top end and bottom end flaps are then closed and glued to the side end flaps. The top end or bottom end flaps may overlap the other. The interlocking separator pad is held in position by the leading flap on each end which is lodged between the articles or containers on that end of the carton and the side end flaps. The tabs that extend through the slots in the side end flaps prevent the separator pad from moving towards the top or bottom panel of the carton after some cans have been removed from the carton.

The carton and interlocking separator pad of this invention is used to carry two layers of cans or other articles, with each layer having two or more rows. Preferably each layer has three rows of cans or articles. The cans or articles are arranged in a group with the interlocking separator pad placed on top of the group of cans and another group of cans is stacked on top of the interlocking separator pad. The two layers of cans are then pushed into the carton and the leading flaps on the interlocking separator pad pushed up or down and the side end flaps closed with the tabs on the separator pad extending through the slots.

This carton may have a dispenser for dispensing cans from each layer one at a time. The dispenser may be located in a side panel for dispensing cans from the carton when the carton is resting on the end adjacent to the dispenser. This dispenser can be formed by two parallel tear lines forming a dispenser flap in the side panel with these parallel tear lines extending across the side panel and into the adjoining top and bottom panels where the bottom and top tear lines are interconnected. These tear lines are spaced apart by a distance approximately equal to the diameter of a can to be carried in the carton. A tear line may interconnect the top and bottom tear lines in the side panel and have a finger flap foldably attached to each side of the tear line which essentially divides the flap into two portions. These finger flaps can be pushed in to enable a person to grasp the two portions of the flap and pull them open forming the dispenser opening for dispensing cans from each layer. The bottom tear line for forming the dispenser flap is spaced close enough to the end of the carton upon which it rests during dispensing to prevent cans from rolling out of the opening. This bottom tear line should not be placed so far from this end of the carton as to make it difficult to remove cans immediately adjacent this end of the carton. Preferably the tear lines interconnecting the top and bottom tear lines in the bottom panel and in the top panel are curved like the cans are curved to permit the easy grasping of the end of a can when the dispenser flap has been removed. For most cans this bottom tear line need only be located approximately one inch from the end of the carton on which it is resting during dispensing. A tear line may be provided in the top panel and in the bottom panel between the bottom tear line and the end of the carton on which the carton rests when cans are being dispensed to form a ledge between the bottom tear line and the end of the carton. If these tear lines between the bottom tear line and the end of the carton are torn open, and the ledge moved forward, it will provide less resistance to the removal of cans from the dispenser opening. Having a dispenser opening in a side panel of the carton for dispensing cans while the carton rests upon its end adjacent the dispenser opening provides a large display area in the side panel above the dispenser for advertising to the consumer. This carton may have a carrying handle formed by two finger holes in the top panel. These cartons may be constructed by gluing, taping, stapling and the like. Two dispensers could be provided for each carton.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION OF THE PREFERRED EMBODIMENT

The present invention is primarily for use with cans of the type used to contain meat products, vegetables and fish. The carton of this invention is primarily useful for cans that are stacked in the carton in two layers with two of more rows in each layer. These cans typically only have a height of two or three inches, and typically these cans are stacked in a carton in two layers of twelve cans in each layer in a three by four configuration.

Figure 1:
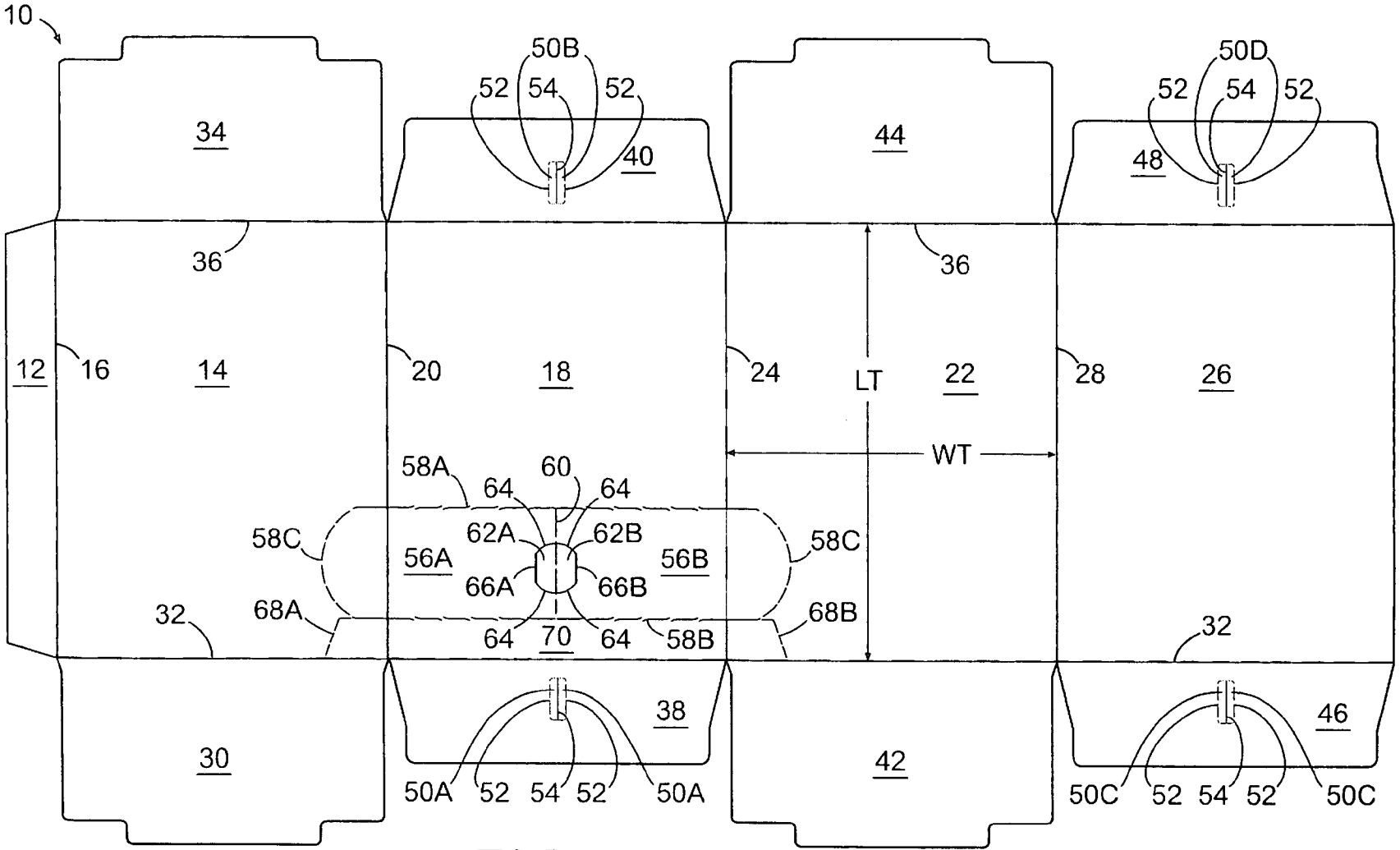
FIG. 1 is a plan view of a blank of which a carton according to one embodiment of this invention is constructed.
Figure 1A:
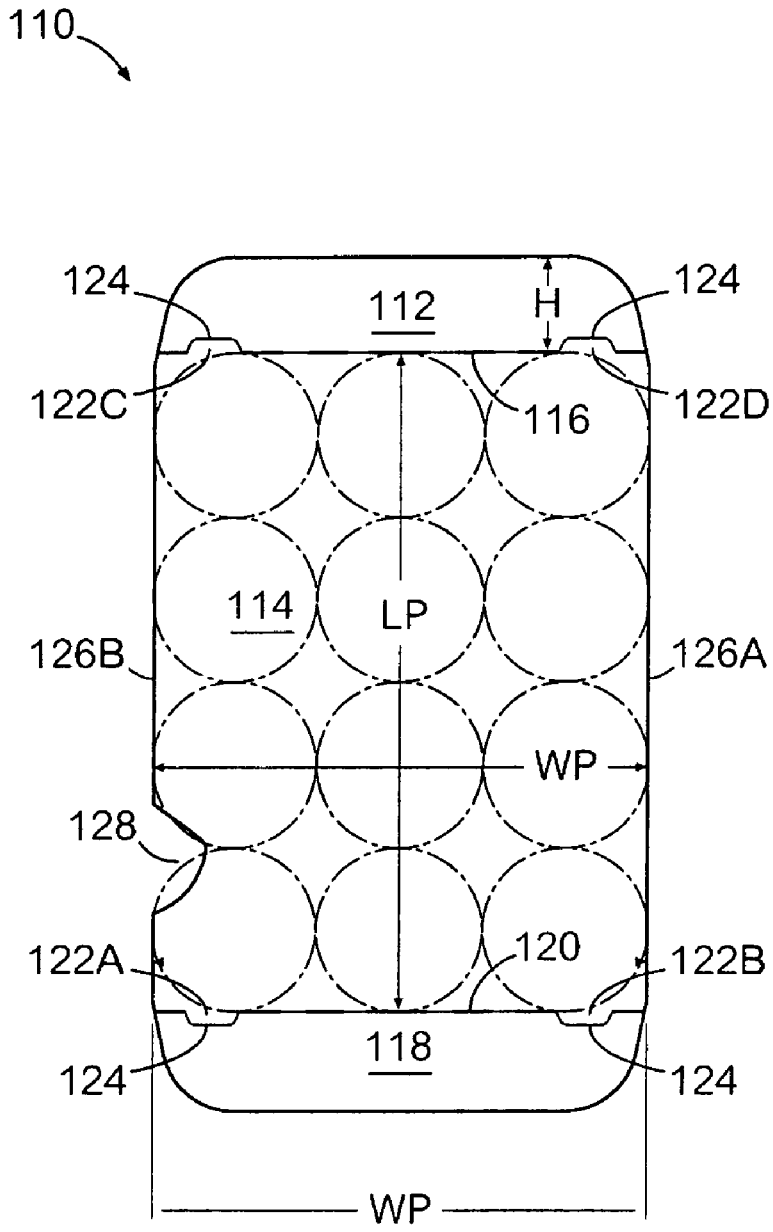
FIG. 1A is a plan view for an interlocking separator pad according to one embodiment of this invention.

As illustrated in FIG. 1, the blank 10 for forming the carton of this invention is formed from a foldable sheet of material, such as paperboard. The blank 110 for forming the interlocking separator pad is also formed from a foldable sheet of material, such as paperboard, as illustrated in FIG. 1A.

The blank 10 for forming the carton of this invention has a glue flap 12 which is attached to bottom panel 14 by fold line 16 and interconnected to side panel 18 by fold line 20. Side panel 18 is connected to top panel 22 by fold line 24, and interconnected to opposite side panel 26 by fold line 28.

Bottom panel 14 is connected to bottom end flap 30 by fold line 32 and connected to opposite bottom end flap 34 by fold line 36. Side panel 18 is connected to side end flap 38 by fold line 32 and to opposite side end flap 40 by fold line 36. Top panel 22 is connected to top end flap 42 by fold line 32 and to opposite top end flap 44 by fold line 36. Opposite side panel 26 is connected to side end flap 46 by fold line 32 and to opposite side end flap 48 by fold line 36.

Side end flaps 38 and 46 each have a pair of slot flaps 50A and 50C which are attached to side end flaps 38 and 46 in which they are formed. Between each pair of slot flaps 50A and 50C is cut line 54, with each slot flap connected to the side end flap by fold line 52. The function of these slot flaps is explained infra. The other end of the carton has two pairs of slot flaps 50B and 50D in side end flaps 40 and 48. Each slot flap 50B and 50D is attached to the side end flaps by fold line 52 with a cut line 54 separating each pair of slot flaps.

Figure 4:
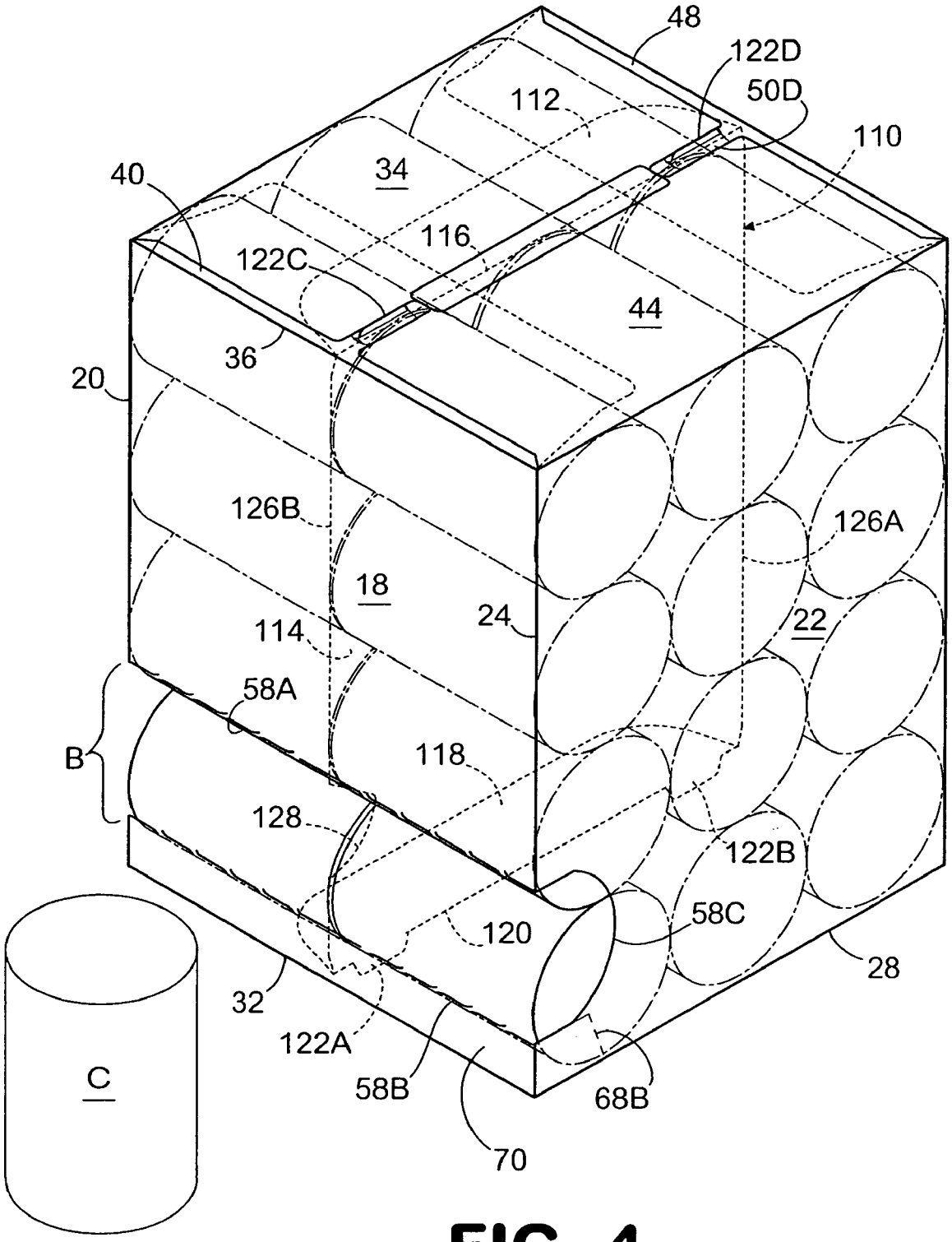
FIG. 4 is a perspective view of the loaded and closed carton of FIG. 3 which shows the carton resting on its end near the side dispenser which is open for dispensing cans.

This carton may have a dispenser opening B in a side panel as best illustrated in FIG. 4. The dispenser opening B (as shown in FIG. 4) may be made available by providing a dispenser flap shown as two portions 56A and 56B, in the side panel 18 that extends into the bottom panel 14 and top panel 22 as shown in FIG. 1. This dispenser flap 56A and 56B is formed by top tear line 58A and bottom tear line 58B which are parallel to each other in side panel 18. Finger flaps 62A and 62B may be provided along middle tear line 60 which separates dispenser flap portions 56A and 56B to assist in opening this flap. Finger flap 62A is attached to portion 56A by fold line 66A and finger flap 62B is attached to portion 56B by fold line 66B. Finger flaps 62A and 62B can be formed by providing cuts 64. Top tear line 58A and bottom tear line 58B for forming the portions 56A and 56B extend into the bottom panel 14 and are interconnected by interconnecting tear lines 58C. In a similar fashion top tear line 58A and bottom tear line 58B extend into top panel 22 and are interconnected by interconnecting tear lines 58C. The interconnecting tear lines 58C of both the bottom panel 14 and top panel 22 are curved like the cans the carton is designed to carry to permit the ends of the cans in the dispenser opening to be grasped and easily removed.

To facilitate removing cans from the dispenser opening B (as shown in FIG. 4) after the portions 56A and 56B have been removed, tear lines 68A and 68B may be provided to permit the movement of the dispenser ledge 70 formed between bottom tear line 58B and fold line 32 to ease the removal of cans through the dispenser opening B.

Normally a carton formed from the blank of FIG. 1 only has provision for one dispenser opening B. Of course, a carton could be constructed that has the provision for two dispenser openings B.

A blank 110 for forming an interlocking separator pad for the carton formed from blank 10 is illustrated in FIG. 1A primarily for use with dispenser opening B (FIG. 4). This blank 110 has a leading flap 112 which is foldably attached to separator pad 114 by fold line 116 and foldable attached to leading flap 118 by fold line 120. Each end of the separator pad 114 has two locking tabs 122A–D which are separated from the adjoining leading flap 112 or 118 by a cut line 124. It will be noticed that each tab 122A–D is located near an edge 126A or 126B of the separator pad 114 which helps insure the stability of the pad in the carton. The width WP of the separator pad 114 must be at least slightly less than the width WT of the top panel 22 between fold lines 24 and 28 of the carton formed from the blank 10 of FIG. 1. The length LP of the separator pad 114 must be approximately the same length as the length LT of the carton as illustrated in blank 10. The separator pad 114 may have a cutout 128 which is designed to be located adjacent the dispenser opening of the carton to facilitate the easy removal of cans from the dispenser opening B.

Figure 2:
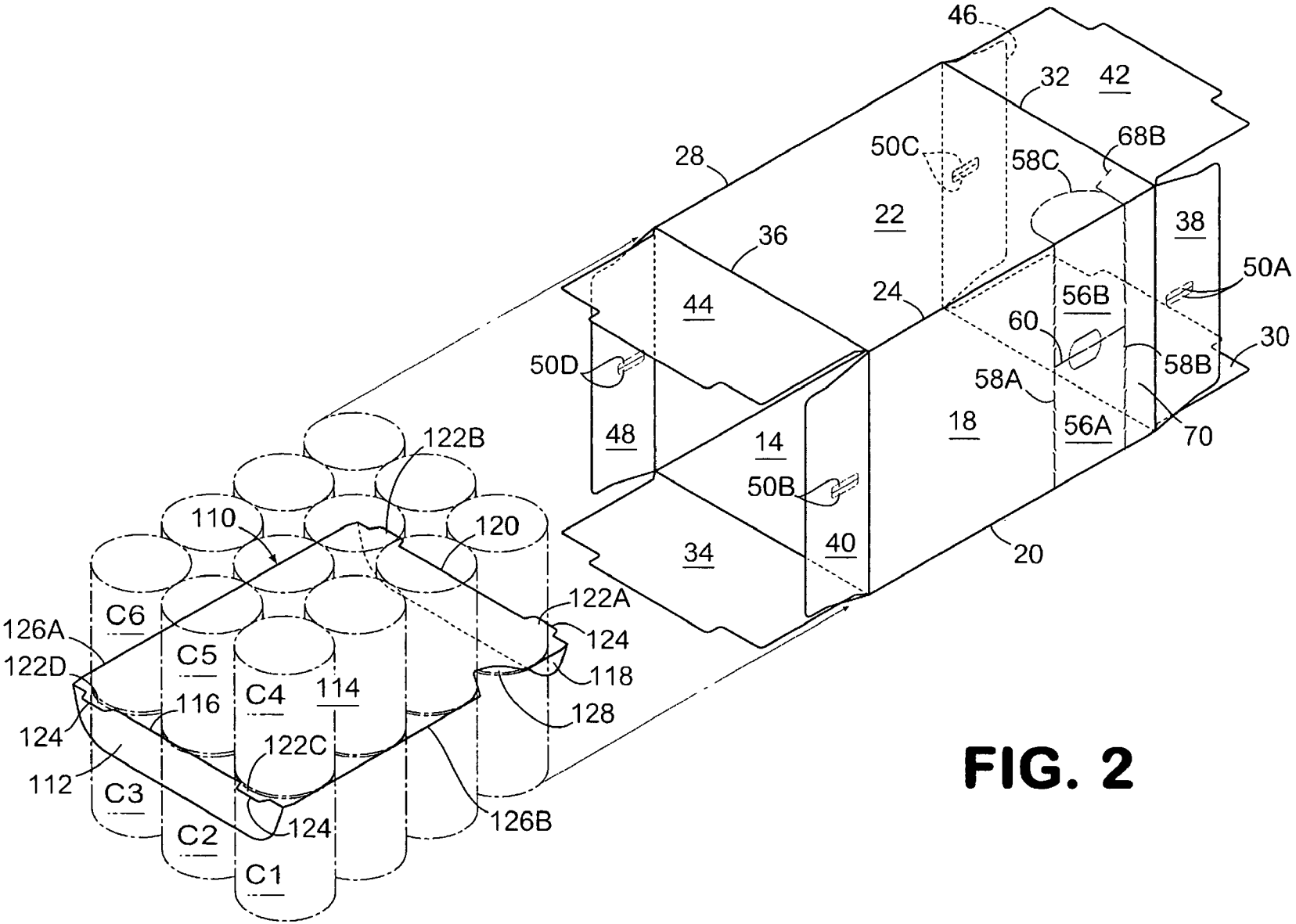
FIG. 2 is a perspective view of a carton formed from the blank of FIG. 1 and the separator pad of FIG. 1A that has been placed between two layers of cans for loading into the carton.
Figure 3:
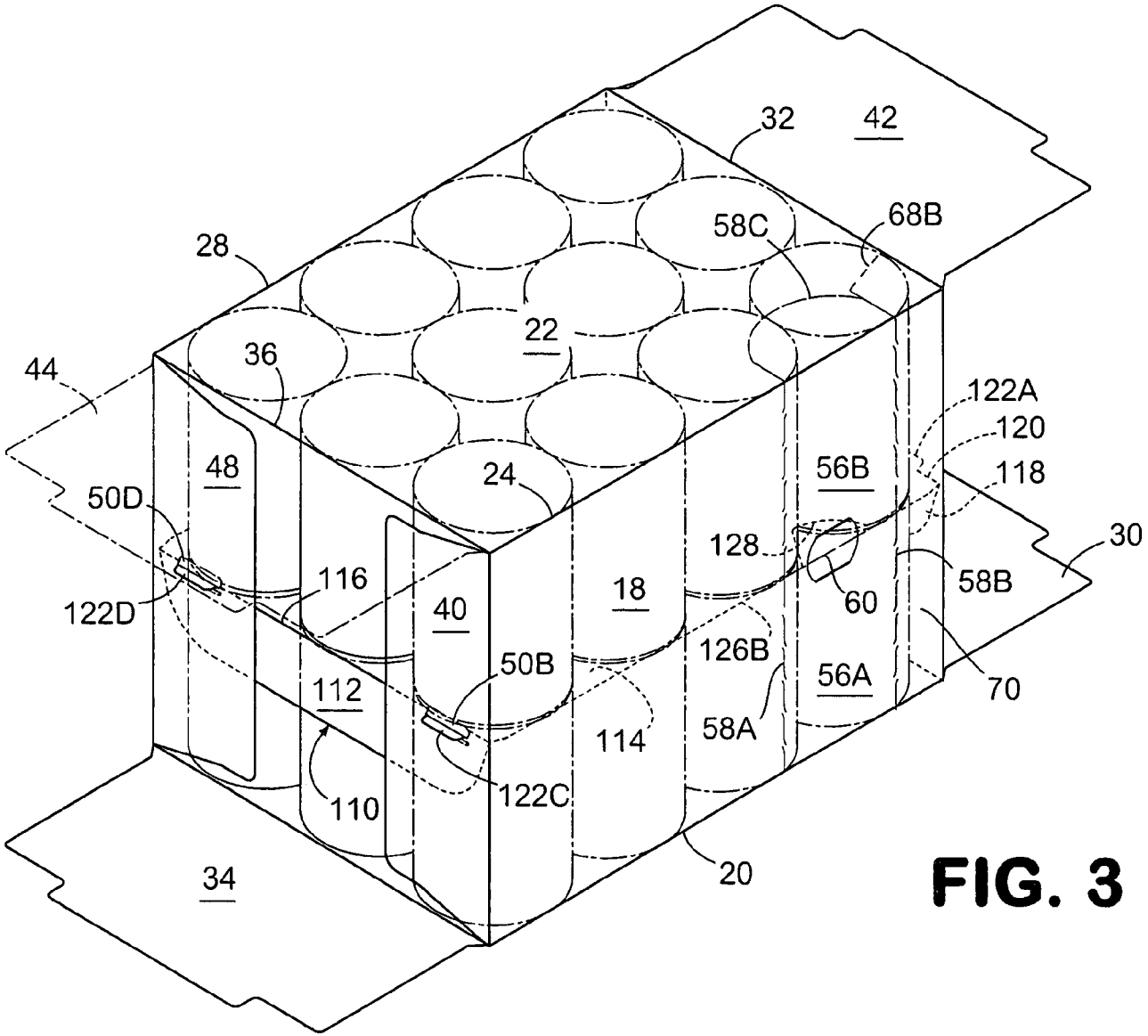
FIG. 3 is perspective view of the end of the carton with the cans loaded in both layers with the separator pad extending between each layer of cans with the side end flaps closed with the tabs on the separator pad extending through the slots on the side end flaps.

The blank 10 of this embodiment is formed into a carton sleeve by gluing glue flap 12 to opposite side panel 26 to form a sleeve as illustrated in FIG. 2. The blank 110 for the interlocking separator pad 114 is placed on top of three rows of cans, as illustrated by C1, C2 and C3, in one layer in FIG. 2. The carton sleeve in FIG. 2 is shown with the top panel 22 in the top position. Because the bottom panel 14 and top panel 22 are identical, the carton sleeve can also be loaded with the bottom panel 14 in the top position. It should be pointed out that it is preferable to have three rows of cans in each layer in the carton. In FIG. 2 a second layer of three rows of cans represented by cans C4, C5 and C6 is placed on top of separator pad 114. The two layers of cans with the separator pad 114 between them is then pushed into the carton sleeve by pushing leading flap 112 until both layers of cans are inside the carton sleeve as shown in FIG. 3. FIG. 3 is a perspective view of this end of the carton into which the cans and separator pad 114 have been inserted and the leading flap 112 has been folded down and side end flaps 40 and 48 have been folded into the closed position. Tabs 122C and 122D push through each pair of slot flaps 50B and 50D so that the tabs extend through the slot formed by opening each pair of slot flaps 50B and 50D. These slot flaps 50B and 50D assist in sealing the carton. The tabs 122C and 122D hold the separator pad 114 from moving between the top panel 22 and bottom panel 14 in the carton. On the other end of the carton leading flap 118 is folded down or up and side end flaps 38 and 46 closed with tabs 122A and 122B projecting through the slot formed when each pair of slot flaps 50A and 50C is moved outward. The height H of the leading flap 112 must be less than the height of articles or containers to be contained in the carton. By designing the carton so that it fits tightly around the articles or containers, the tabs 122A–D need not be folded up or down. However, they can be made slightly longer so they can be folded up or down if desired.

The carton ends can be closed by folding bottom end flaps 30 and 34 upward and folding top end flap 42 and 44 downward and gluing them to the side end flaps. Top end flaps 42 and 44 can be constructed so that they overlap the bottom end flaps 30 and 34 if desired. The combination of the tabs 122A–D and the leading flaps 112 and 118 hold the separator pad 114 in the proper position even when cans have been removed from one of the layers in the carton through the dispenser opening B. The normal method of securing the ends of the carton is by gluing the end flaps together.

FIG. 4 is a perspective view showing the dispenser opening of the carton which is resting on its end adjacent the dispenser opening. In the embodiment of the carton that has dispenser opening B as shown in FIG. 4, the dispenser flap 56A and 56B can be easily opened by pushing in finger flaps 62A and 62B and tearing dispensing flap 56A and 56B open along top tear line 58A and bottom tear line 58B and removing the flap. A can C can be removed from each layer of cans as shown in FIG. 4. The distance between top tear line 58A and bottom tear line 58B should be approximately equal to the diameter of a can. The distance between bottom tear line 58B and fold line 32 should be significantly less than the diameter of a can to allow cans adjacent to this end of the carton to be removed through the dispenser opening, but high enough to prevent cans from automatically rolling out of the carton when the dispenser opening B is open. Preferably the distance between bottom tear line 58B and fold line 32 is approximately one inch for many sizes of cans. The dispenser B is designed to be used when the carton is resting on the end defined by bottom end flap 30, side end flap 38, top end flap 42 and side end flap 46. The dispenser ledge 70 between the bottom tear line 58B and fold line 32 can be moved forward by tearing along tear lines 68A and 68B.

The interlocking of the separator pad 114 by the provision of leading flaps 112 and 118 lodged between the articles or containers contained in the carton and the side end flaps 38, 46, 40, and 48 and the tabs 112A–D extending through the slot formed by the movement of each pair of slot flaps 50A–D ensures that the separator pad 114 remains in the proper position during the removal of cans through the dispenser opening B. Thus, the separator pad 114 is prevented from moving between the top and bottom panels as cans are removed from dispenser opening B. The interlocking of the separator pad 114 with the ends of the carton by the tabs and slots and leading flaps dispenses with any need for gluing the separator pad 114 in position Placing the tabs 122A–D adjacent the edges 126A and 126B of the separator pad 114 helps ensure the stability of the separator pad 114 to the carton.

The separator pad 114 can be constructed with a single leading flap 112, but two flaps ensures the stability of the pad in the carton. The separator pad can have more than two tabs 122A–D on each end if needed.

The ends of the carton are normally secured together by gluing, but can be stapled or otherwise affixed together.

While the invention has been disclosed in its preferred forms, it will be apparent to those skilled in the art that many modifications, additions, and deletions can be made therein without departing from the spirit and scope of the invention and its equivalents as set forth in the following claims.

Therefore, having thus described the invention, at least the following is claimed:

1. An article carrying carton with two ends loaded with a plurality of articles comprising:

(a) said carton having a bottom panel, top panel and foldably attached adjoining side panels, with each end being an interlocking end which is closed by a top end flap foldably attached to the top panel, a bottom end flap foldably attached to the bottom panel and a side end flap fold ably attached to each side panel, with each side end flap having at least one slot, with said end flaps being held together by closing means;

(b) two layers of articles; and (c) an interlocking separator pad located between the two layers of articles, said pad having two ends, both of which are interlocking ends, with each end having at least two tabs extending through the slots in the side end flaps on an end of the carton, with at least one end of the interlocking pad having a leading flap which has been folded into a plane which is at least substantially parallel to the side end flaps and being lodged between the side end flaps and a layer of articles in the carton.

2. The carton loaded with a plurality of articles of claim 1, in which the means of closing the end flaps on each end of the carton is by gluing the top end flap and bottom end flap to the side end flaps.

3. The carton loaded with a plurality of articles of claim 1, in which both ends of the interlocking pad have a leading flap.

4. The carton loaded with a plurality of articles of claim 2, in which both ends of the interlocking pad have a leading flap.

5. The carton loaded with a plurality of articles of claim 4, in which the articles are cylindrical containers with two ends with an axis extending between the two ends, said axes of the cylindrical containers being perpendicular to the separator pad.

6. The carton loaded with a plurality of cylindrical containers of claim 5, which are arranged in three rows in each layer.

7. The carton loaded with a plurality of cylindrical containers of claim 6, said carton having a dispenser flap which when removed provides an opening which permits the removal of the containers from each layer, said dispenser flap formed by a bottom tear line in a side panel which is at least substantially parallel to an end of the carton and a top tear line spaced apart from said bottom tear line and is at least substantially parallel thereto, said bottom and top tear lines extending into the adjoining top panel and interconnecting each other and extending into the adjoining bottom panel and interconnecting each other, said parallel tear lines being spaced apart by a distance sufficient to permit the removal through said opening of a container by a person.

8. The carton loaded with a plurality of cylindrical containers of claim 7, in which the separator pad has two edges with two tabs on each end being spaced apart with each tab located near an edge, with each corresponding slot in a side end flap being located near a side panel.

9. The carton loaded with a plurality of cylindrical containers of claim 8, in which said bottom tear line in the side panel of the carton is located from the closest side end flap by a distance which is sufficient to prevent a container adjacent the closest side end flap from rolling out of the opening formed when the dispenser flap is removed when the carton is resting on the end where said side end flap is located, but with said bottom tear line not being so far from said closest side end flap to prevent the removal through said opening of a container adjacent said closest side end flap.

10. The carton loaded with a plurality of cylindrical containers of claim 9, in which the tear lines that extend into the adjoining bottom panel and adjoining top panel of the carton extend into each said panel far enough to permit a person to grasp the adjacent end of a container through the opening formed when the dispenser flap is removed.

11. The carton loaded with a plurality of cylindrical containers of claim 10, in which a tear line interconnects said bottom tear line and top tear line in said side panel of the carton to facilitate opening said dispenser flap.

12. The carton loaded with a plurality of cylindrical containers of claim 11, which has at least one finger flap in the dispenser flap adjacent to the tear line connecting the top and bottom tear lines together in said side panel to facilitate tearing the dispenser flap open.

13. The carton loaded with a plurality of cylindrical containers of claim 12, which has a tear line in the bottom panel between the bottom tear line and the closest bottom end flap and a tear line in the top panel between the bottom tear line and the closest top end flap to enable a person to move that portion of the side panel between the bottom tear line and the closest side end flap a sufficient distance to permit the easy removal of containers from the opening formed by the removal of the dispenser flap.

14. A carton with two ends for carrying a plurality of cylindrical containers in two layers with three rows in each layer and an interlocking separator pad for keeping the layers of containers separate comprising:

(a) a carton having a bottom panel, top panel and foldably attached adjoining side panels, with each end of the carton being an interlocking end, with each end of carton being closed by a top end flap foldably attached to the top panel, a bottom end flap foldably attached to the bottom panel and a side end flap which is foldably attached to each side panel, with each side end flap having at least one slot, with each end of the carton having been closed by gluing the top end flap and bottom end flap to the side end flaps on that end of the carton; and (b) an interlocking separator pad with two ends, both of which are interlocking ends, with each end having at least two tabs extending through the slots in the side end flaps on an end of the carton, with at least one end of the interlocking pad having a leading flap which has been folded into a plane which is at least substantially parallel to the side end flaps.

15. The carton with the interlocking separator pad of claim 14, in which both ends of the interlocking separator pad have a leading flap.

16. The carton with interlocking separator pad of claim 15, said carton having a dispenser flap which when removed provides an opening which permits the removal of the containers from each layer, said dispenser flap formed by a bottom tear line in a side panel which is at least substantially parallel to an end of the carton and a top tear line spaced apart from said bottom tear line and is at least substantially parallel thereto, said bottom and top tear lines extending into the adjoining top panel and interconnecting each other and extending into the adjoining bottom panel and interconnecting each other, said parallel tear lines being spaced apart by a distance sufficient to permit the removal through said opening of a container by a person.

17. The carton with interlocking separator pad of claim 16, in which said bottom tear line in the side panel of the carton is located from the closest side end flap by a distance which is sufficient to prevent any container in the carton adjacent to the closest side end flap from rolling out of the opening formed when the dispenser flap is removed when the carton is resting on the end where said side end flap is located, but with said bottom tear line not being so far from said closest side end flap to prevent the removal through said opening of a container adjacent said closest side end flap.

18. The carton with interlocking separator pad of claim 17, in which the tear lines that extend into the adjoining bottom panel and adjoining top panel of the carton extend into each said panel far enough to permit a person to grasp the adjacent end of a container through the opening formed when the dispenser flap is removed.

19. The carton with interlocking separator pad of claim 18, in which a tear line interconnects said bottom tear line and top tear line in said side panel to facilitate opening said dispenser flap.

20. The carton with interlocking separator pad of claim 19, which has at least one finger flap in the dispenser flap adjacent to the tear line connecting the top and bottom tear lines together in said side panel to facilitate tearing the dispenser flap open.

21. The carton with interlocking separator pad of claim 20, which has a tear line in the bottom panel between the bottom tear line and the closest bottom flap and a tear line in the top panel between the bottom tear line and the closest top end flap to enable a person to move that portion of the side panel between the bottom tear line and the closest side end flap a sufficient distance to permit the easy removal of containers from the opening formed by the removal of the dispenser flap.

22. A blank for a carton with two ends for carrying a plurality of cylindrical containers in two layers with at least two rows in each layer and an interlocking separator pad for keeping the layers of containers separated comprising:

(a) said carton blank having a bottom panel, top panel and foldably attached adjoining side panel, with each end of the carton being an interlocking end, with each end of the carton being designed to be closed by a top end flap foldably attached to the top panel, a bottom end flap foldably attached to the bottom panel and a side end flap which is foldably attached to each side panel, with each side end flap having at least one slot, with each end being designed to be closed by gluing the top end flap and bottom end flap to the side end flaps on that end of the carton; and (b) an interlocking separator pad which is designed to be located between two layers of containers, said pad having two ends, both of which are interlocking ends, with each end having at least two tabs which are designed to be extended through the slots in the side end flaps, with at least one end of the pad having a foldably attached leading flap, said leading flap being designed to be folded into a plane parallel to the side end flaps between said flaps and the layer of containers in the carton.

23. The blank for a carton and interlocking separator pad of claim 22, in which both ends of the interlocking pad have a leading flap.

24. The blank for a carton and interlocking separator pad of claim 23, in which each side end flap has a slot and each end of the interlocking separator pad has two tabs.

25. The blank for a carton and interlocking separator pad of claim 24, in which said blank for the carton has a dispenser flap which when removed from the carton formed and loaded with containers provides an opening which permits the removal of the containers from each layer, said dispenser flap formed by a bottom tear line in a side panel which is at least substantially parallel to an end of the carton and a top tear line spaced apart from said bottom tear line and is at least substantially parallel thereto, said bottom and top tear lines extending into the adjoining top panel and interconnecting each other and extending into the adjoining bottom panel and interconnecting each other, said parallel tear lines being spaced apart by a distance sufficient to permit the removal through said opening of a container by a person.

26. The blank for a carton and interlocking separator pad of claim 24, in which said blank for the carton has a pair of flaps that extend into each slot in each side end flap so that that the slot is filled with the tab extending through the slot and the flaps to assist in sealing the carton when it has been formed and loaded with containers.

27. The carton loaded with a plurality of articles of claim 3, in which the carton has a pair of flaps that extend into each slot in each side end flap so that the slot is filled with the tab extending through the slot and the flaps to assist in sealing articles in the carton.

28. An interlocking separator system for separating two layers of cylindrical containers in a carton with a dispenser both while the dispenser is closed and while it is open with the containers being removed through the dispenser, said carton having two ends, each of which is closed by pair of side end flaps, a bottom end flap and a top end flap, said interlocking separator system comprising;

(a) each side end flap having a slot; and (b) an interlocking separator pad which is designed to separate two layers of containers, said pad having two ends, both of which are interlocking ends, with each end having two tabs extending through the slots in the side end flaps on an end of the carton, with each end of the interlocking end pad having a leading flap which has been folded into a plane which is at least substantially parallel to the side end flaps and designed to be lodged between the side end flaps and a layer of containers to be contained in the carton.

29. A carton loaded with a plurality of articles, comprising;

a bottom panel;

a top panel;

a first side panel;

a second side panel;

a first end panel at least partially closing a first end of the carton and comprising a first plurality of end flaps;

a second end panel at least partially closing a second end of the carton;

a first layer of articles;

a second layer of articles; and an interlocking separator pad having a first end and a second end and located between the first and second layers of articles, wherein the first end of the pad has at least one first tab that extends through at least one first aperture in the first end panel, and wherein the first end of the pad has a first flap that, is folded and lodged between the first end panel and one of the layers of articles.

30. The carton and plurality of articles of claim 29, wherein:

the at least one first tab comprises two first tabs; and the at least one first aperture comprises two first apertures, each first tab extending through one of the first apertures.

31. The carton and plurality of articles of claim 30, wherein the separator pad further comprises:

at least one second tab at the second end of the separator pad and extending through an aperture in the second end panel; and a second flap folded into a plane which is substantially parallel to the second end panel and lodged between the second end panel and one of the layers of articles.

32. The carton and plurality of articles of claim 31, wherein the second end panel comprises a second plurality of end flaps.

33. The carton and plurality of articles of claim 31, wherein the first plurality of end flaps comprises:

a first top end flap foldably attached to the top panel;

a first bottom end flap foldably attached to the bottom panel; and two first side end flaps one first side end flap being foldably attached to each side panel.

34. The carton and plurality of articles of claim 33, wherein the two apertures in the first end panel comprise two slots, one slot being disposed in each first side end flap.

35. The carton and plurality of articles of claim 34, wherein the aperture in the second end panel comprises at least one slot.

36. The carton and plurality of articles of claim 29, wherein the articles are substantially cylindrical containers with two ends and an axis extending between the two ends, the axes of the cylindrical containers being substantially perpendicular to the separator pad.

37. The carton and plurality of articles of claim 36, wherein the articles are arranged in three rows an each layer.

38. The carton and plurality of articles of claim 29, wherein the carton further comprises a dispenser flap which when removed provides an opening which permits the removal of the containers from the carton.

* * * * *